US007243730B2

(12) United States Patent
Casey

(10) Patent No.: US 7,243,730 B2
(45) Date of Patent: Jul. 17, 2007

(54) WELL PRODUCTION OPTIMIZING SYSTEM

(76) Inventor: Danny M. Casey, 211 Stubblefield Lake Rd., Huntsville, TX (US) 77340

( * ) Notice: Subject to any disclaimer, the term of this patent is extended or adjusted under 35 U.S.C. 154(b) by 274 days.

(21) Appl. No.: 11/031,136

(22) Filed: Dec. 31, 2004

(65) Prior Publication Data

US 2006/0144597 A1 Jul. 6, 2006

(51) Int. Cl.
*E21B 43/12* (2006.01)
*E21B 33/068* (2006.01)

(52) U.S. Cl. ..... 166/372; 166/68; 166/106; 166/135; 166/192; 166/383; 166/386

(58) Field of Classification Search ..... None
See application file for complete search history.

(56) References Cited

U.S. PATENT DOCUMENTS

| | | | |
|---|---|---|---|
| 4,352,376 | A | 10/1982 | Norwood |
| 4,408,676 | A | 10/1983 | McCoy |
| 4,750,583 | A | 6/1988 | Wolf |
| 4,793,178 | A | 12/1988 | Ahern et al. |
| 4,921,048 | A | 5/1990 | Crow et al. |
| 5,132,904 | A | 7/1992 | Lamp |
| 5,146,991 | A | 9/1992 | Rogers, Jr. |
| 5,427,504 | A | 6/1995 | Dinning et al. |
| 6,045,335 | A | 4/2000 | Dinning |
| 6,148,923 | A | 11/2000 | Casey |
| 6,209,637 | B1 | 4/2001 | Wells |
| 6,241,014 | B1 | 6/2001 | Majek et al. |
| 6,467,541 | B1 | 10/2002 | Wells |
| 6,595,287 | B2 | 7/2003 | Fisher |
| 6,634,426 | B2 | 10/2003 | McCoy et al. |
| 6,637,510 | B2 | 10/2003 | Lee |
| 6,688,385 | B1 | 2/2004 | Moe |
| 6,719,060 | B1 | 4/2004 | Wells |
| 6,725,916 | B2 | 4/2004 | Gray et al. |

*Primary Examiner*—Zakiya W. Bates
(74) *Attorney, Agent, or Firm*—Winstead PC; Henry L. Ehrlich

(57) ABSTRACT

A well optimizing system and method for lifting fluid that accumulates and retards production in a well. The system includes a plunger having a piston and a detachable plugh. The piston has a sealing section and a retrieval end and defines a passage through the length thereof. One or more pads are radially extendable from the sealing section. The detachable plug is positional in the retrieval end in a position to substantially block the flow of fluid through the passage from below the plunger. The system may further include a production control system.

20 Claims, 5 Drawing Sheets

WELL PRODUCTION OPTIMIZING SYSTEM

RELATION TO CO-PENDING APPLICATIONS

This application is related to co-pending patent application Ser. No. 10/992,060, filed Nov. 18, 2004 and entitled Well Production Optimizing System, which is incorporated in its entirety herein.

FIELD OF THE INVENTION

The present invention relates in general to producing fluids from a well and more specifically to a plunger lift system.

BACKGROUND

In the life of most wells the reservoir pressure decreases over time resulting in the failure of the well to produce fluids utilizing the formation pressure solely. As the formation pressure decreases, the well tends to fill up with liquids, such as oil and water, which inhibits the flow of gas into the wellbore and may prevent the production of liquids. It is common to remove this accumulation of liquid by artificial lift systems such as plunger lift, gas lift, pump lifting and surfactant lift wherein the liquid column is blown out of the well utilizing the reaction between surfactants and the liquid.

One method of producing fluids from a declining well having gas production is by utilizing a plunger lift system. A well is shut-in allowing a plunger to fall through the fluid column to the bottom of the well. When gas pressure from the formation is sufficient, the well may be opened allowing the gas to lift the plunger and the fluid above the plunger to the surface for production. The plunger acts as an interface between the gas and liquid in the well. However, when gas pressure is overcome by the hydrostatic head in the well, well production will cease.

Wells that are candidates for plunger lift are already very susceptible to being killed. These wells are commonly killed by allowing excessive liquid to accumulate in the well. Fluid may accumulate from allowing the well to remain flowing for too great a period of time or wiping fluid from the interior of the tubing, or both. The margin of error for maintaining production is further decreased as the well declines and the gas volume produced at the formation decreases.

Typical plunger lift systems require a well that produces a substantial quantity of gas. Therefore, there is a need for a plunger lift system that facilitates continued production of declining wells with decreasing produced gas volumes and gas pressures.

SUMMARY OF THE INVENTION

In view of the foregoing and other considerations, the present invention relates to plunger lift systems and optimizing production from a well.

Accordingly, a well optimizing system is provided, the system includes a plunger having a piston and a detachable plug. The piston has a sealing section and a retrieval end and defines a passage through its length. One or more pads are radially extendable from the sealing section. The detachable plug is positional in the retrieval end in a position to substantially block the flow of fluid through the passage from below the plunger. The pads may be biased outward from the piston to form a sealing and sliding engagement with the tubing. The plug may have a spherical shape, such as a ball or have a blunt spherical section for receipt in the retrieval end. The retrieval end may define an angular shaped cavity to receive and to align the detachable plug in the blocking position of the passage.

The well optimizing system of the present invention may further include a system for controlling the well in real time. The system including a flow-control valve in fluid connection with the tubing, the flow-control valve being moveable between a closed position to prevent fluid flow from the tubing and an open position allowing fluid flow from the tubing, a pulse generator in fluid communication with the tubing for transmitting a pressure pulse into the fluid in the tubing, a receiver in operational connection with the tubing for receiving the pressure pulse and pressure pulse reflections from a surface in the tubing and for sending an electrical signal in response to the received pressure pulses and a controller in functional connection with the flow-control valve, the pulse generator and the receiver; wherein the controller operates the position of the flow-control valve in response to the well status determined by the controller from the receipt and analysis of the electrical signals from the receiver. The well status may include the liquid level in the tubing, the position and speed of the plunger in the tubing, the position and speed of the piston in the tubing, the position and the speed of the ball in the tubing.

A method of optimizing a well's production includes the steps of: a) providing a plunger including a piston having a sealing section and a retrieval end, the piston defining a passage therethrough, one or more pads radially extendable from the sealing section and a detachable plug positionable in the retrieval end in a blocking position substantially eliminating fluid flow through the passage; b) positioning the plunger within a tubing at the top of the tubing, wherein the piston is positioned above the detachable plug relative to the well and the pads are in sliding engagement with the tubing and substantially seal between the tubing and the piston; c) dropping the detachable plug in the tubing independent of the piston; d) dropping the piston in the tubing wherein fluid in the well passes through the passage of the piston; e) nesting the detachable plug in the blocking position in the retrieval end of the piston effecting a substantial seal across the diameter of the tubing; f) allowing formation gas pressure below the nested plunger to push the plunger and liquid above the plunger toward the top of the tubing; g) producing the liquid above the plunger from the well; and h) repeating steps c) through g).

The method may further include the steps of providing a flow-control valve in fluid connection with the tubing, the flow-control valve moveable between a closed position to prevent fluid flow from the tubing and an open position allowing fluid flow from the tubing, disrupting the fluid in the tubing with a pulse generator to create a pressure pulse transmitted through the fluid in the tubing; detecting the pressure pulse created and the pressure pulse reflected from objects located within the tubing; converting the detection of the pressure pulse and the reflected pressure pulses to a signal; computing the signals to determine a well status; and controlling the position of the flow-control valve in response to the well status determined by the controller from the receipt and analysis of the electrical signals from the receiver.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1A:
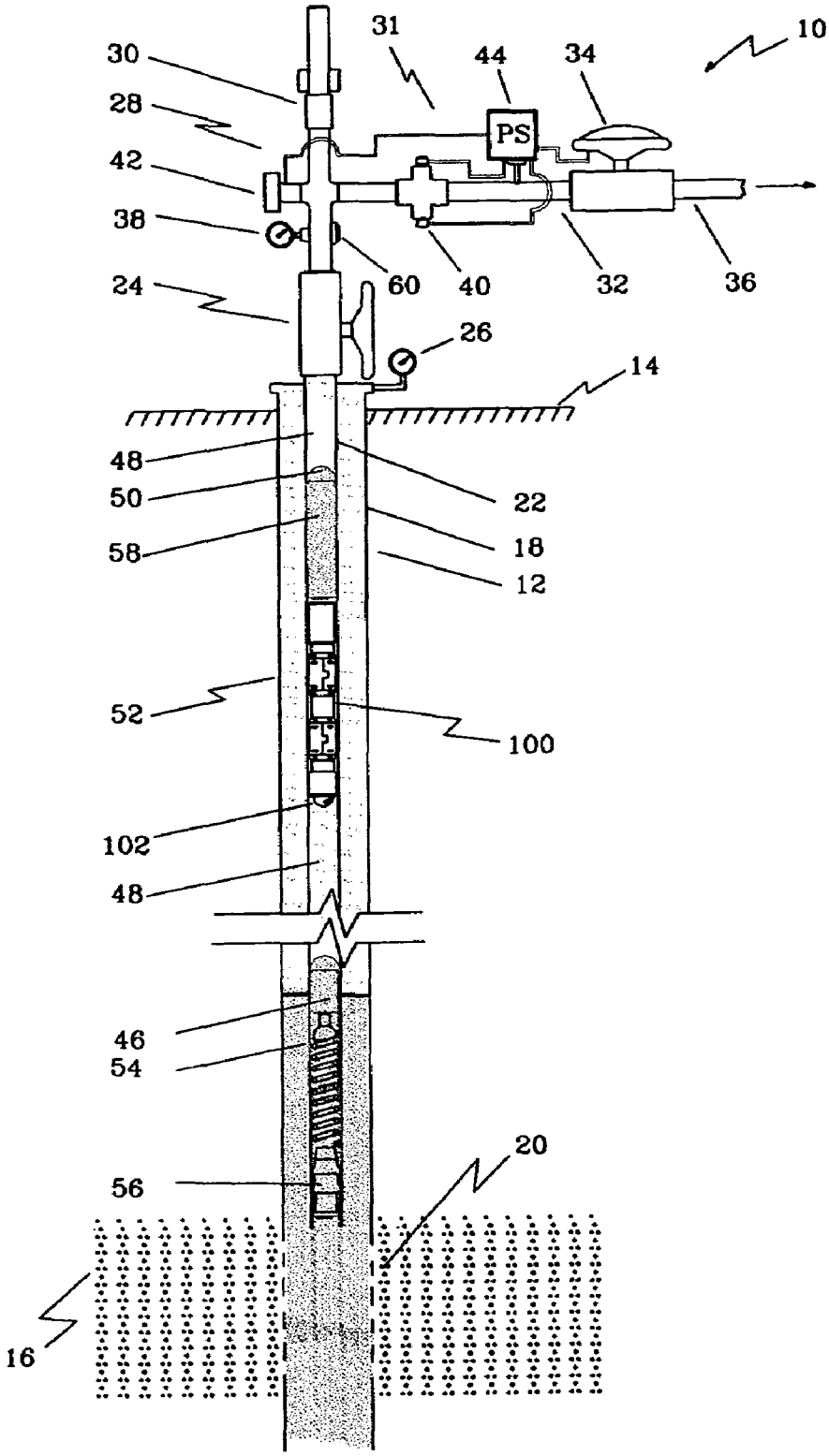
FIG. 1A is a schematic drawing of a well production optimizing system of the present invention illustrating the plunger ascending in the well.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Figure 1B:
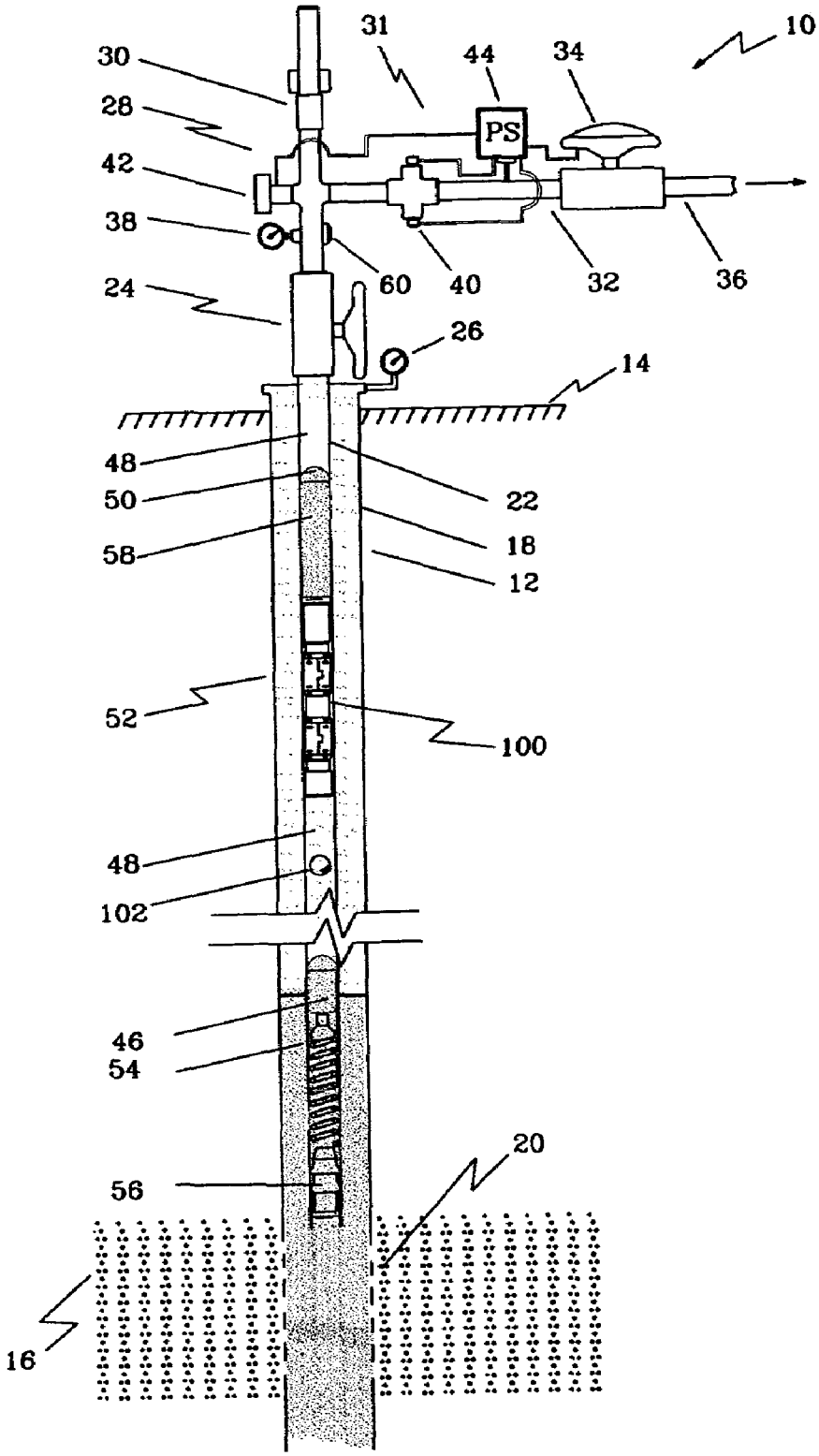
FIG. 1B is a schematic drawing of a well production optimizing system of the present invention illustrating the piston and the detachable plug descending, separate and independent from one another, in the well.

FIGS. 1A and 1B are a schematic drawing of a well production optimizing system of the present invention, generally denoted by the numeral 10. The Figures are illustrative of a well utilizing a plunger lift system. The well includes a wellbore 12 extending from the surface 14 of the earth to a producing formation 16. Wellbore 12 may be lined with a casing 18 including perforations 20 proximate producing formation 16. The surface end of casing 18 is closed at surface 14 by a wellhead generally denoted by the numeral 24. A casing pressure transducer 26 is mounted at wellhead 24 for monitoring the pressure within casing 18.

A tubing string 22 extends down casing 18. Tubing 22 is supported by wellhead 24 and in fluid connection with a production "T" 28. Production "T" 28 includes a lubricator 30, also referred to as a catcher, and a flow line 31 having a section 32, also referred to as the production line, upstream of a flow-control valve 34, and a section 36 downstream of flow-control valve 34. Downstream section 36, also referred to generally as the salesline, may lead to a separator, tank or directly to a salesline. Production "T" 28 typically further includes a tubing pressure transducer 38 for monitoring the pressure in tubing 22.

Wellbore 12 is filled with fluid from formation 16. The fluid includes liquid 46 and gas 48. The liquid surface at the liquid gas interface is identified as 50. With intermittent lift systems it is necessary to monitor and control the volume of liquid 46 accumulating in the well to maximize production.

Well production optimizing system 10 may include a flow-control valve 34, a flow-interruption pulse generator 40, a receiver 42 and a controller 44. Flow-control valve 34 is positioned within flow line 31 and may be closed to shut-in wellbore 12, or opened to permit flow into salesline 36.

Flow-interruption pulse generator 40 is connected in flow line 31 so as to be in fluid connection with fluid in tubing 22. Although pulse generator 40 is shown connected within flow line 31 it should be understood that pulse generator 40 may be positioned in various locations such that it is in fluid connection with tubing 22 and the fluid in wellbore 12.

Pulse generator 40 is adapted to interrupt or affect the fluid within the tubing 22 in a manner to cause a pressure pulse to be transmitted down tubing 22 and to be reflected back upon contact with a surface. Pulse generator 40 is described in more detail below.

Receiver 42 is positioned in functional connection with tubing 22 so as to receive the pressure pulses created by pulse generator 40 and the reflected pressure pulses. Receiver 42 recognizes pressure pulses received and converts them to electrical signals that are transmitted to controller 44. The signal is digitized and the digitized data is stored in controller 44.

Controller 44 is in operational connection with pulse generator 40, receiver 42 and flow-valve 34. Controller 44 may also be in operational connection with casing pressure transducer 26, tubing pressure transducer 38 and other valves (not shown). Controller 44 includes a central processing unit (CPU), such as a conventional microprocessor, and a number of other units interconnected via a system bus. The controller includes a random access memory (RAM) and a read only memory (ROM), and may include flash memory. Controller 44 may also include an I/O adapter for connecting peripheral devices such as disk units and tape drives to the bus, a user interface adapter for connecting a keyboard, a mouse and/or other user interface devices such as a touch screen device to the bus, a communication adapter for connecting the data processing system to a data processing network, and a display adapter for connecting the bus to a display device which may include sound. The CPU may include other circuitry not shown herein, which will include circuitry found within a microprocessor, e.g., an execution unit, a bus interface unit, an arithmetic logic unit (ALU), etc. The CPU may also reside on a single integrated circuit (IC).

Controller 44 may be located at the well or at a remote location such as a field or central office. Controller 44 is functionally connected to flow-control valve 34, receiver 42, and pulse generator 40 via hard lines and/or telemetry. Data from receiver 42 may be received, stored and evaluated by controller 44 utilizing software stored on controller 44 or accessible via a network. Controller 44 sends signals for operation of pulse generator 40 and receives information regarding receipt of the pulse from pulse generator 40 via receiver 42 for storage and use. The data received by controller 44 is utilized by controller 44 to manipulate the production cycle, during the production cycle in real-time, to optimize production. Controller 44 may also be utilized to display real-time as well as historical production cycles in various formats as desired.

FIG. 1A illustrates a multi-part pad plunger, generally denoted by the numeral 52, having a piston 100 and a plug 102 ascending in tubing 22 from spring 54 toward catcher 30. Fluid enters casing 18 through perforations 20 and into tubing 22 through standing valve 56. A liquid slug 58 is carried to surface 14 and flowline 31 by plunger 52. Lubricator 30 catches plunger 52 when it is driven to the surface. FIG. 1B illustrates piston 100 and detachable plug 102 descending, separate and independent of one another, in the well. It should be noted that the well optimizing system of the present invention may utilize the control system and plunger 52, singularly or in combination. Plunger 52 is described in detail in relation to FIG. 2.

Figure 2:
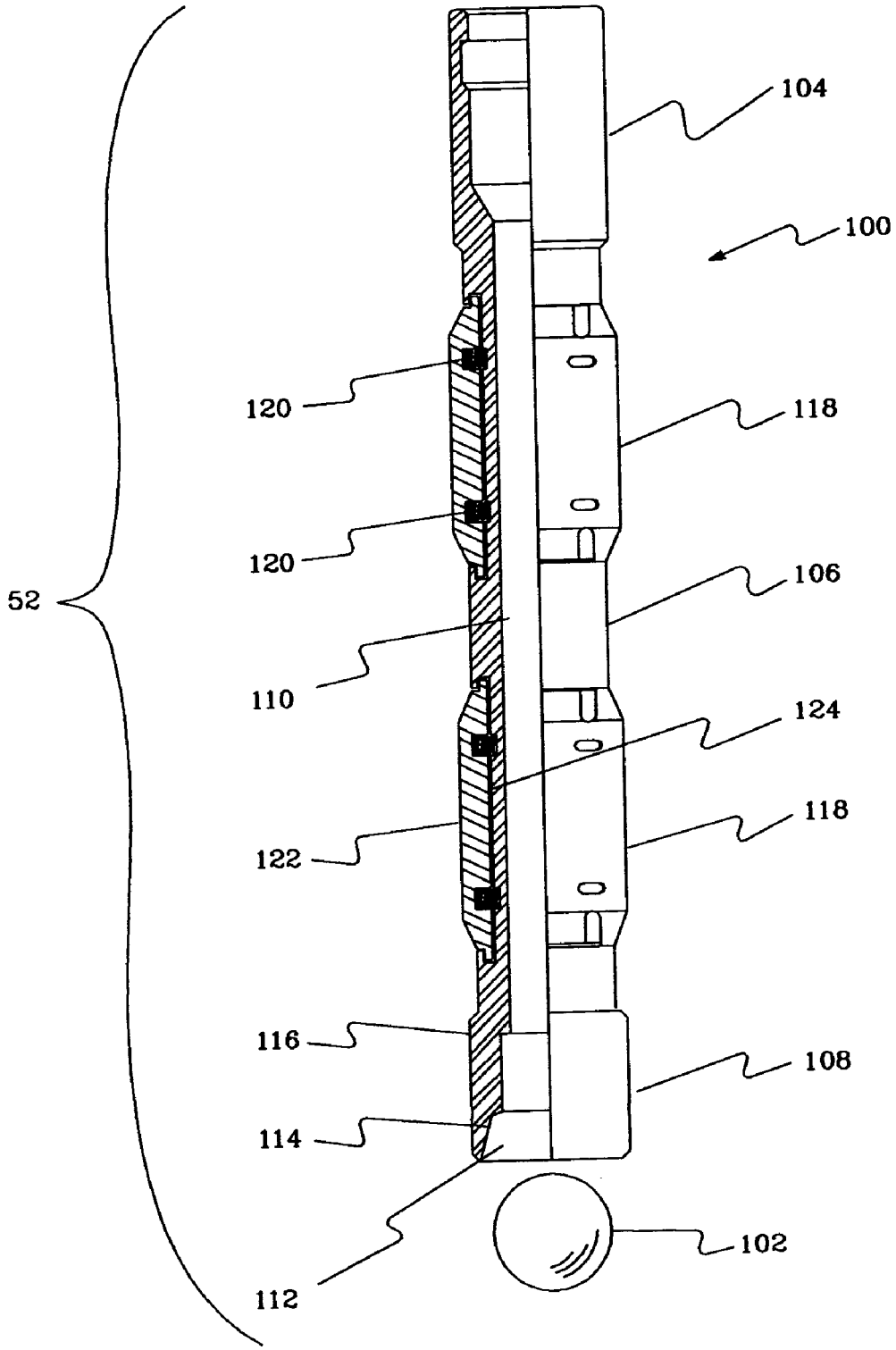
FIG. 2 is a partial cross-sectional view of a plunger of the present invention.

FIG. 2 is a partial, cross-sectional view of plunger 52 of the present invention.

With reference to FIGS. 1 and 2, plunger 52 is a pad type bypass plunger having a piston 100 and a detachable plug 102. Piston 100 comprises a fishneck end 104, a sealing section 106 and a retrieval end 108. The fishneck end 104, middle section 106 and retrieval end 108 may be formed as an integral unit or as three separate pieces connected together. A by-pass passage 110 is formed through piston 100 along the longitudinal axis thereof for allowing fluid to pass through piston 100 when by-pass passage 110 is open.

The top end 104 is often referred to as a fishneck and provides a mechanism for retrieving the plunger from well 12 if necessary. Fishneck end 104 may form an internal or an external fishneck.

Sealing section 106 provides a seal between the inner walls of the well, shown as tubing 22, and piston 100. This seal must be capable of sliding past restrictions within tubing 22 and be slidingly and sealingly engageable with tubing 22. Sealing section 106 includes a mandrel 116 having an internal wall that defines by-pass passage 110 and an external wall carrying pads 118. Pads 118 are radially moveable between an innermost position and an outermost position so that they contact the inner wall of tubing 22 to substantially seal between plunger 52 and the inner wall of tubing 22. Radial movement of pads 118 is provided by biasing mechanisms 120.

Pads 118 may be constructed of one or more materials suitable for the well conditions and that are satisfactorily wear resistant without destroying the conduit in which it slides. Pads 118 have an outer surface 122 and an inner surface 124. Outer surface 122 may define a convex arc with a radius similar to the inner wall of tubing 22. Inner surface 124 faces mandrel 116. Inner surface 124 may interact with the outer surface of mandrel 116 in a manner such that when pads 118 are in an outermost position the passage of fluid between pads 118 and mandrel 116 is limited maintaining a substantial seal between piston 100 and tubing 22.

Retrieval end 108 forms a cavity 112 continuous with by-pass passage 110 adapted for retrieval of detachable plug 102 at the bottom of well 12, which is typically at spring 54. Cavity 112 has a radius greater than the radius of detachable plug 102 and smaller than by-pass passage 110. It is desired that the internal wall 114 of retrieval end 108 be angular shaped toward by-pass passage 110 so as to receive and align detachable plug 102 into a sealing and blocking position of by-pass passage 110. Desirably a portion of internal wall 114 is smooth and shaped to match the contour of plug 102, thus the radius of curvature of internal wall 144 is substantially equal to the radius of curvature of plug 102. Cavity 112 may be sized so as to encompass a portion or all of detachable plug 102. Retrieval end 108 may further include o-rings or other devices such as disclosed in U.S. Pat. No. 6,148,923, the disclosure of which is incorporated herein in its entirety by reference, for detachably holding plug 102.

Detachable plug 102 is adapted to fall independently of piston 100 when plunger 52 descends in the well. When plug 102 and piston 100 reach the bottom of well 12, plug 102 nests in cavity 112 blocking by-pass passage 110. When plug 102 is nested and in a blocking position, gas is limited from by-passing plunger 52 through passage 110 and around plunger 52. Thus, when the gas pressure is sufficient, plunger 52 and the fluid above it are lifted to the surface.

In a preferred embodiment, plug 102 is spherically shaped as a ball, or as an elongated member having a spherically shaped end. Plug 102 is adapted for free fall through tubing 22 without wiping fluid from the walls of tubing 22. The spherical shape limits lodging of plug 102 in tubing 22 and provides for consistent nesting in cavity 112. In one preferred embodiment, plug 102 is constructed of a metallic or elastomeric material or a combination of both. Plug 102 may be hollow. It is also contemplated that plug 102 may be elongated or bullet shaped, such as described in U.S. Pat. No. 6,148,923.

In a typical plunger-lift system operation the well is shut-in by closing a flow-control valve for a pre-selected time period during which sufficient formation pressure is developed within the casing to move the plunger, along with fluid collected in the well, to the surface. When the well is shut-in the plunger descends to the bottom of the well. This shut-in period is often referred to as "off time."

After passage of the selected "off-time" the production cycle is started by opening the flow-control valve. As the plunger rises in response to the downhole casing pressure, the fluid slug is lifted and produced into the salesline. In the prior art plunger-lift systems when the plunger reaches the lubricator, its arrival is noted by an arrival sensor and a signal is sent to controller to close the flow-control valve, shutting in the well and ending the cycle production cycle. It may be desired to allow the control-valve to remain open for a pre-selected time to flow gas from the well. The continued flow period after arrival of the plunger at the lubricator is referred to as "after-flow." Upon completion of a pre-selected after-flow period a controller may send a signal to the flow-control valve to close. Thereafter, the plunger falls through the tubing to a spring. The production cycle then begins again with an off-time, ascent stage, after-flow, and descent stage.

One of the several drawbacks of these prior art plunger lift systems is the excessive shut-in or "off-time" of the well. The shut-in period is detrimental to the economic success and viability of the well. When the well is shut-in there is no product being produced and thus no income. Additionally, when the well is shut-in, the solid plunger of the prior art accumulates (gathers, pushes) liquid into the well; thereby increasing the gas pressure required to lift the plunger and the liquid and increasing the risk of killing the well.

Pad type by-pass plunger 52 of the well optimizing system of the present invention addresses drawbacks of the prior art plunger lift systems. Plunger 52 facilitates significantly limiting, if not eliminating, the required shut-in or "off-time" of the well. Plunger 52 of the present invention reduces the critical minimum gas pressure and minimum gas volume requirements for producing the well utilizing plunger lift. By increasing the number of plunger trips in a period of time, less fluid is lifted in each ascent, thus, the gas pressure required for the ascent is reduced. By utilizing appropriate sealing between tubing 22 and plunger 52 the volume of gas is conserved and directed to lifting fluid.

Operation of plunger 52 of the present invention is described with reference to FIGS. 1 and 2. Beginning with plunger 52 positioned at the bottom of wellbore 12 and resting on spring 54, plug 102 is nested within cavity 112. In the nested position, plug 102 blocks passage 110 thereby preventing gas from bypassing plunger 52 through passage 110. Biasing mechanism 120 urges pads 118 outwardly into a sliding and sealing engagement with the inside wall of tubing 22. Pads 118 form a seal between plunger 52 and tubing 22 that substantially limits the gas that may flow from below plunger 52 toward surface 14 through the tubing/plunger annulus. As gas pressure increases below plunger 52 it will lift plunger 52 and any liquid slug to surface 14 (FIG. 1A).

Upon arrival of plunger 52 at surface 14 the liquid slug 58 is directed to the flowline 31 and detachable plug 102 is released from piston 100, opening by-pass passage 110. Detachable plug 102 may be released from piston 100 in several manners. One manner of releasing plug 102 is by utilizing a rod that passes through passage 110 from the top. Another method is to "catch" piston 100 and by briefly closing control valve 34, plug 102 will separate from piston 100.

Once plug 102 is released from piston 100, it will separately and independently descend to spring 54 (FIG. 1B). Desirably, plug 102 is sized so as to limit the removal of liquid from the inside wall of tubing 22. Additionally, it may be desirable to size plug 102 so that fluid is not trapped below it as it descends thus reducing its rate of descent.

After plug 102 is separated from piston 100, passage 110 is open allowing fluid to pass through passage 110 and piston 100 begins to descend in tubing 22. The present invention allows piston 100 to descend while the well is flowing. As piston 100 descends, pads 118 scrape accumulated liquid from the interior wall of tubing 22. The liquid dislodged from the tubing is transported by the up-flowing gas stream through passage 110 above piston 100 reducing the accumulation of liquid at the bottom of wellbore 12 and providing rapid descent of piston 100.

As piston 100 nears the bottom of wellbore 12 it may enter a column of liquid that has accumulated. Piston 100 will continue to descend and join or nest with plug 102. The nested piston 100 and plug 102 form a single plunger 52 effectively sealing across the tubing diameter separating the volume of fluid above plunger 52 from the volume of liquid and gas below plunger 52.

The two-part plunger 52 facilitates a large diameter by-pass passage 110 resulting in a faster falling piston 100 relative to some single part prior art by-pass plungers. Additionally, a pad type plunger provides more effective sealing reducing the gas bypassing the plunger. It has further been realized that the pad-type plunger has a greater longevity and is more efficient over time than a disc type by-pass plunger. As can be seen, the present invention facilitates reduction, if not elimination, of the shut-in time of the well thereby increasing production and reducing the likelihood of killing the well.

In another embodiment of optimizing system 10 of the present invention, the production cycle of the plunger-lift system may be monitored and controlled in real-time, during each production cycle, to optimize production from the well.

With reference to FIG. 1 and co-pending patent application Ser. No. 10/992,060, which is incorporated herein by reference, a well production optimizing system 10 of the present invention is described. To control and optimize the well production, controller 44 intermittently operates pulse generator 40 creating a pressure pulse that travels down tubing 22 and is reflected off of liquid surface 50 and plunger 52. The pressure pulse and reflections are received by receiver 42 and sent to controller 44 and stored as data. Controller 44 may receive further data such as casing pressure 26, tubing pressure 38 and flow rates into salesline 36. Additionally, data such as well fluid compositions and characteristics may be maintained by controller 44. This cumulative data is monitored and analyzed by controller 44 to determine the well status. This well status data may include data, such as, but not limited to liquid surface 50 level, fluid volume in the well, the rate of change of the level of liquid surface 50, the position of plunger 52 in tubing 22, the ascent speed of plunger 52, the descent speed of plug 102 and piston 100, the position of plunger 52 in the tubing, the position of piston 100 in the tubing, the position of plug 102 in the tubing and the in-flow performance rate (IPR). The well status data may then be utilized by controller 44 to alter the operation of the production system. This status data may also be utilized by controller 44 or an operator to determine the wear and age characteristics of plunger 52 for replacement or repair.

For example, as plunger 52 ascends in tubing 22, the well status data calculated and received by controller 44 may indicate that the rate of ascension is too fast and may result in damage to plunger 52 and/or lubricator 30. Controller 44 may then signal flow-control valve 34 to close or restrict flow through valve 34 thereby slowing or stopping the ascension of plunger 52.

In a further example, controller 44 may recognize that plunger 52 is ascending too slow, stalled or falling during the ascent. Controller 44 may then close flow-control valve 34 to terminate the trip, or further open flow-control valve 34 or open a tank valve to allow plunger 52 to rise to lubricator 30.

In a still further example, in the descent stage, the controller 44 well status data may indicate that liquid 46 is accumulating in tubing 22. Controller 44 can signal flow-control valve 44 to close and allow plug 102 and piston 100 to descend more rapidly to spring 54 for nesting. Then a new production cycle may be initiated by again opening flow-control valve 44.

Figure 3:
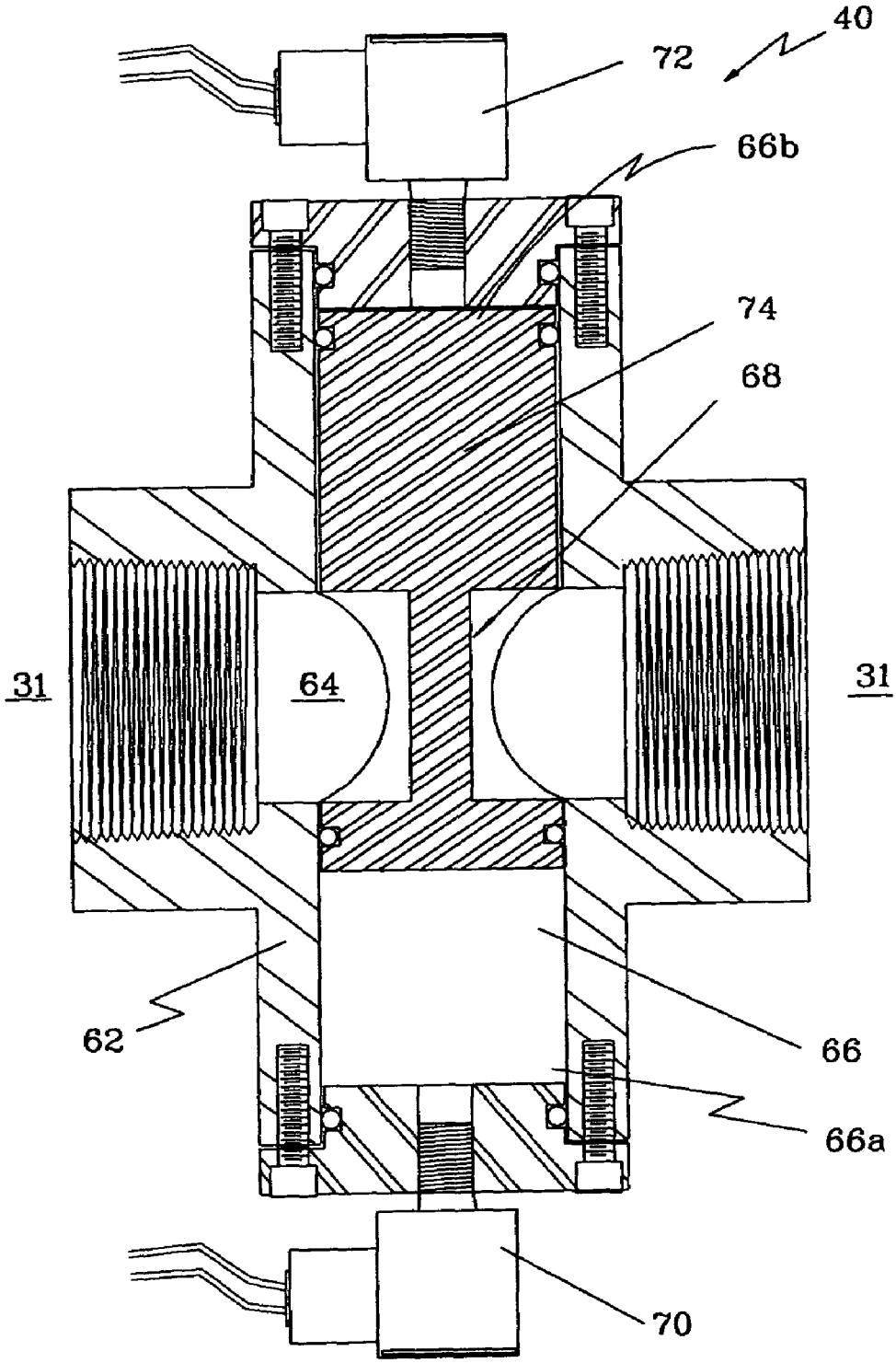
FIG. 3 is partial cross-sectional view of a flow-interruption pulse generator of the present invention.

FIG. 3 is a partial cross-sectional view of a flow-interruption pulse generator 40 of the present invention. Pulse generator 40 includes a valve body 62 forming a fluid channel 64, a cross-bore 66 intersecting channel 64 and a piston 68. Electromagnetic solenoids 70 and 72 are connected to the first and second ends 66*a* and 66*b* of bore 66 respectively. Solenoids 70 and 72 are functionally connected to controller 44 (FIG. 1) for selectively venting bore 66 and motivating movement of piston 68. Operation of solenoids 70 and 72 moves piston head 74 from the second end 66*b* of bore 66 into channel 64 and then back into bore 66.

Operation of pulse generator 40 to create a pressure pulse is described with reference to FIGS. 1 and 3. Pulse generator 40 is connected within flowline 31 through channel 64. Controller sends a signal to solenoid 70 to vent motivating piston 68 and moving piston head 74 into channel 64. Controller 44 then sends a signal to solenoid 72 to vent motivating piston 68 and moving piston head 74 from channel 64 and toward second bore end 66*b*. This fast acting movement of piston head 74 into flow channel 64 creates a pressure pulse that travels through the fluid in flowline 31 and tubing 22.

Figure 4:
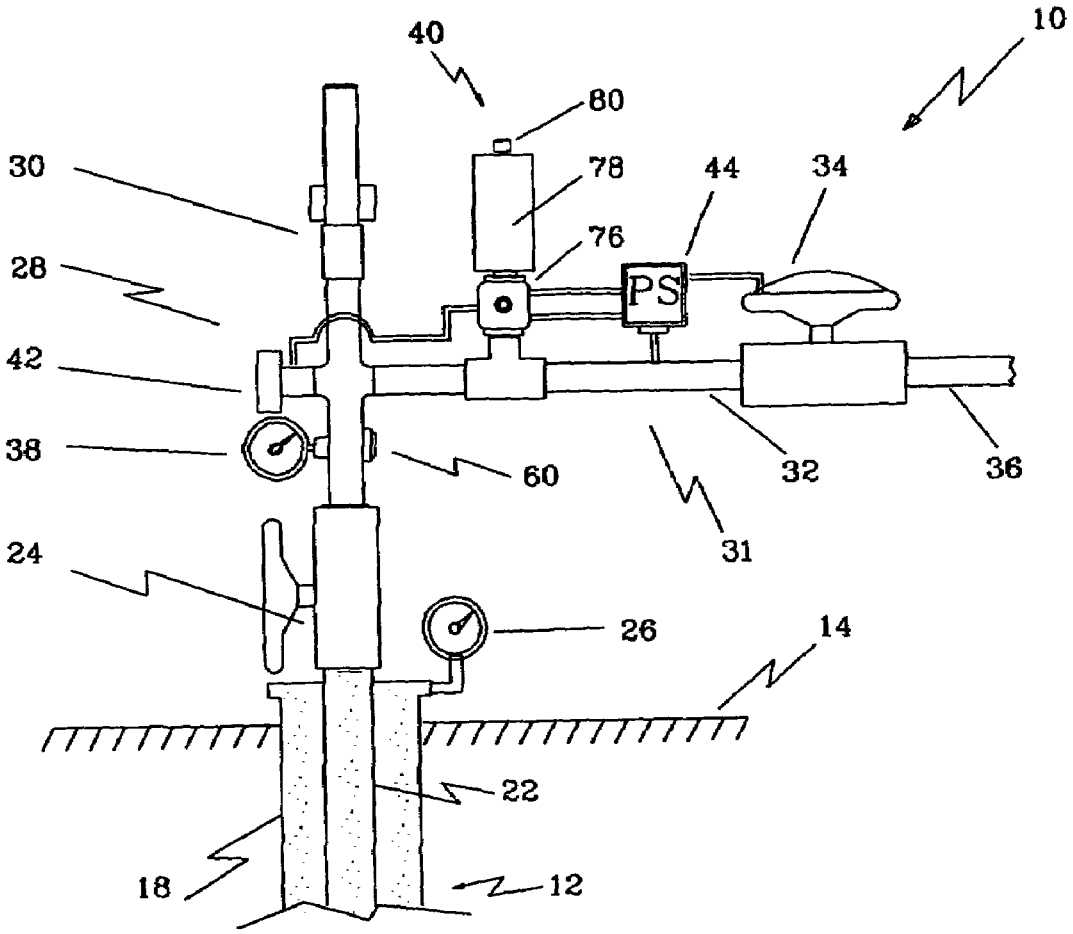
FIG. 4 is a view of another embodiment of a flow-interruption pulse generator of the present invention.

FIG. 4 is a view of another embodiment of a flow-interruption pulse generator 40 of the present invention. Pulse generator 40 includes a fast acting, motor driven valve 76 in fluid connection with flowline 31. Motor driven valve 76 is in operational connection with controller 44. To create a pressure pulse in flowline 31 and tubing 22, controller 44 substantially instantaneously opens and closes valve 76 releasing gas from flowline 31. Pulse generator 40 may include a vent chamber 78 connected to fast-acting valve 76. Vent chamber 78 may further include a bleed valve 80 to facilitate bleeding gas captured in vent chamber 78 to be discharged to the atmosphere.

From the foregoing detailed description of specific embodiments of the invention, it should be apparent that a method and apparatus for monitoring and optimizing an artificial lift system that is novel and unobvious has been disclosed. Although specific embodiments of the invention have been disclosed herein in some detail, this has been done solely for the purposes of describing various features and aspects of the invention and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A plunger for optimizing well production, the plunger comprising:

a piston having a sealing section and a retrieval end, the piston defining a passage therethrough;

one or more pads radially extendable from the sealing section; and a detachable plug positionable in the retrieval end in a blocking position to the passage, wherein the plus detaches from the piston and descends independent from the piston in a well.

2. The plunger of claim 1, wherein the one or more pads are biased radially outward from the piston to a sealing and sliding engagement with a tubing.

3. The plunger of claim 2, wherein the retrieval end defines an angular shaped cavity to receive and align the detachable plug in the blocking position of the passage.

4. The plunger of claim 3, wherein the detachable plug has a spherical shape to be received within the retrieval end.

5. The plunger of claim 1, wherein the retrieval end defines an angular shaped cavity to receive and align the detachable plug in the blocking position of the passage.

6. The plunger of claim 1, wherein the detachable plug has a spherical shape to be received within the retrieval end.

7. A well optimizing system, the system comprising:

a plunger comprising a piston having a sealing section and a retrieval end, the piston defining a passage therethrough, one or more pads radially extendable from the sealing section and a detachable plug positionable in the retrieval end in a blocking position substantially eliminating fluid flow through the passage, the plunger moveably positioned within a tubing of a wellbore;

a flow-control valve in fluid connection with the tubing, the flow-control valve moveable between a closed position to prevent fluid flow from the tubing and an open position allowing fluid flow from the tubing;

a pulse generator in fluid communication with the tubing adapted for transmitting a pressure pulse into rue fluid in the tubing;

a receiver in operational connection with the tubing for receiving the pressure pulse and pressure pulse reflections from a surface in the tubing and for sending an electrical signal in response to the received pressure pulses; and a controller in functional connection with the flow-control valve, the pulse generator and the receiver; wherein the controller operates the position of the flow-control valve in response to the well status determined by the controller from the receipt and analysis of the electrical signals from the receiver.

8. The system of claim 7, wherein the one or more pads are biased radially outward from the piston to a sealing and sliding engagement with the tubing.

9. The system of claim 7, wherein the pulse generator comprises:

a valve body forming a fluid channel in communication with the fluid in the tubing;

a cross-bore having a first end and a second end, the cross-bore intersecting the channel; and a piston having a piston head, the piston moveably disposed in the cross-bore in a manner such that the piston bead may be selectively moved to a position in the channel.

10. The system of claim 1, wherein the well status includes the level of a liquid in the tubing.

11. The system of claim 7, wherein the well status includes the speed of travel of the plunger in the tubing.

12. The system of claim 11, wherein the well status further includes:

the position of the piston in (the tubing; and the speed of travel of the piston in the tubing.

13. The system of clam 7, wherein the well status includes the position of the piston in the tubing.

14. The system of claim 7, wherein the well status includes the speed of travel of the piston in the tubing.

15. The system of claim 7, wherein the well status includes at least one of the position of the plunger in the tubing, the position of the detachable plug in the tubing and the speed of travel of the detachable plug in the tubing.

16. A method of optimizing the production from a well, the method comprising the steps of:

a) providing a plunger comprising a piston having a sealing section and a retrieval end, the piston defining a passage therethrough, one or more pads radially extendable from the sealing section and a detachable plug positionable in the retrieval end in a blocking position substantially eliminating fluid flow through the passage;

b) positioning the plunger within a tubing at the top of the tubing, wherein the piston is positioned above the detachable plug relative to the well and the pads are in sliding engagement with the tubing and substantially seal between the tubing and the piston;

c) dropping the detachable plug in the tubing independent of the piston;

d) dropping the piston in the tubing wherein fluid in the well passes through the passage of the piston;

e) nesting the detachable plug in the blocking position in the retrieval end of the piston effecting a substantial seal across the diameter of the tubing;

f) allowing formation gas pressure below the nested plunger to push the plunger and liquid above the plunger toward the top of the tubing;

g) producing the liquid above the plunger from the well; and h) repeating steps c) through g).

17. The method of claim 16, further including the steps of:

providing a flow-control valve in fluid connection with the tubing, the flow-control valve moveable between a closed position to prevent fluid flow from the tubing and an open position allowing fluid flow from the tubing;

disrupting fluid in the tubing with a pulse generator to create a pressure pulse transmitted through the fluid in the tubing;

detecting the pressure pulse created and the pressure pulse reflected from objects located within the tubing;

converting the detection of the pressure pulse and the reflected pressure pulses to a signal;

computing the signals to determine a well status; and controlling the position of the flow-control valve in response to the well status determined by the controller from the receipt and analysis of the electrical signals from the receiver.

18. The method of claim 16, wherein the well status includes the level of a liquid in the tubing.

19. The method of claim 18, wherein the well status further includes:

the position of the piston in the tubing; and the speed of travel of the piston in the tubing.

20. The method 18, wherein the pulse generator comprises:

a valve body forming a fluid channel in communication with the fluid in the tubing;

a cross-bore having a first end and a second end, the cross-bore intersecting the channel; and a piston having a piston head, the piston moveably disposed in the cross-bore in a manner such that the piston head may be selectively moved to a position in the channel.

* * * * *